US006997020B2

(12) United States Patent
Kozak et al.

(10) Patent No.: US 6,997,020 B2
(45) Date of Patent: Feb. 14, 2006

(54) WRIST FITTING APPARATUS FOR HANDCUFFS

(76) Inventors: James E. Kozak, 319 San Luis Rey Rd., Arcadia, CA (US) 91007; Nicholas J. Kozak, 319 San Luis Rey Rd., Arcadia, CA (US) 91007

( * ) Notice: Subject to any disclaimer, the term of this patent is extended or adjusted under 35 U.S.C. 154(b) by 47 days.

(21) Appl. No.: 10/848,725

(22) Filed: May 20, 2004

(65) Prior Publication Data

US 2005/0257580 A1 Nov. 24, 2005

(51) Int. Cl.
*E05B 75/00* (2006.01)

(52) U.S. Cl. ..... 70/16; 128/846; 128/878

(58) Field of Classification Search ..... 70/14, 70/16–19; 128/133, 134, 846, 869, 878, 128/879

See application file for complete search history.

(56) References Cited

U.S. PATENT DOCUMENTS

| | | | | | |
|---|---|---|---|---|---|
| 240,121 | A | * | 4/1881 | Gustaveson | 119/819 |
| 2,106,849 | A | * | 2/1938 | Long | 340/304 |
| 2,991,785 | A | * | 7/1961 | Terrell | 128/876 |
| 3,027,895 | A | * | 4/1962 | Williams | 128/878 |
| 4,299,213 | A | * | 11/1981 | Violet | 128/882 |
| 4,351,169 | A | | 9/1982 | Plymale | |
| 4,526,165 | A | * | 7/1985 | Mielnik et al. | 128/882 |
| 4,574,600 | A | | 3/1986 | Moffett | |
| 4,697,441 | A | | 10/1987 | Allen | |
| 4,741,051 | A | | 5/1988 | Bible | |
| 4,840,048 | A | | 6/1989 | Elam | |
| 4,977,625 | A | | 12/1990 | Charters, III | |
| 5,007,257 | A | | 4/1991 | Thompson | |
| 5,031,641 | A | | 7/1991 | Upton | |
| 5,138,852 | A | | 8/1992 | Corcoran | |
| 5,230,351 | A | | 7/1993 | Nyorkor | |
| D347,156 | S | | 5/1994 | Starrett et al. | |
| 5,343,562 | A | | 9/1994 | Bible | |
| 5,349,966 | A | | 9/1994 | Garcia | |
| D352,572 | S | | 11/1994 | Pustizzi, Jr. | |
| 5,398,383 | A | | 3/1995 | Bingold | |
| 5,400,623 | A | * | 3/1995 | Bota | 70/16 |
| 5,461,890 | A | | 10/1995 | LeFavor | |
| 5,479,943 | A | | 1/1996 | Kuhnell, III | |
| 5,526,658 | A | | 6/1996 | Cross et al. | |
| 5,551,086 | A | | 9/1996 | Albanese | |
| 5,613,381 | A | | 3/1997 | Savage | |
| 5,687,593 | A | | 11/1997 | Cross | |
| 5,697,231 | A | | 12/1997 | Tobin, Jr. | |
| 5,743,117 | A | | 4/1998 | Woo et al. | |
| 5,797,284 | A | | 8/1998 | Lurie | |
| 6,000,249 | A | | 12/1999 | Wilber | |
| 6,026,661 | A | | 2/2000 | Spiropoulos | |
| 6,311,529 | B1 | | 11/2001 | Kang | |
| 6,430,749 | B1 | | 8/2002 | Waheed | |
| 6,574,998 | B2 | | 6/2003 | Kwon | |
| 6,619,077 | B1 | | 9/2003 | Robinson | |
| 6,637,242 | B2 | | 10/2003 | Masters | |
| 6,672,116 | B1 | | 1/2004 | Hilliard | |
| 6,684,666 | B1 | | 2/2004 | Taper | |

* cited by examiner

*Primary Examiner*—Suzanne Dino Barrett
(74) *Attorney, Agent, or Firm*—William W. Haefliger

(57) ABSTRACT

Wrist retention apparatus for handcuffs that have two curved jaws, and a pivot connection for the jaws, comprising in an insert configured to interfit one jaw and present a wrist engaging curved surface toward the other jaw, the insert having a projection configured to fit over a terminal of the jaw.

7 Claims, 4 Drawing Sheets

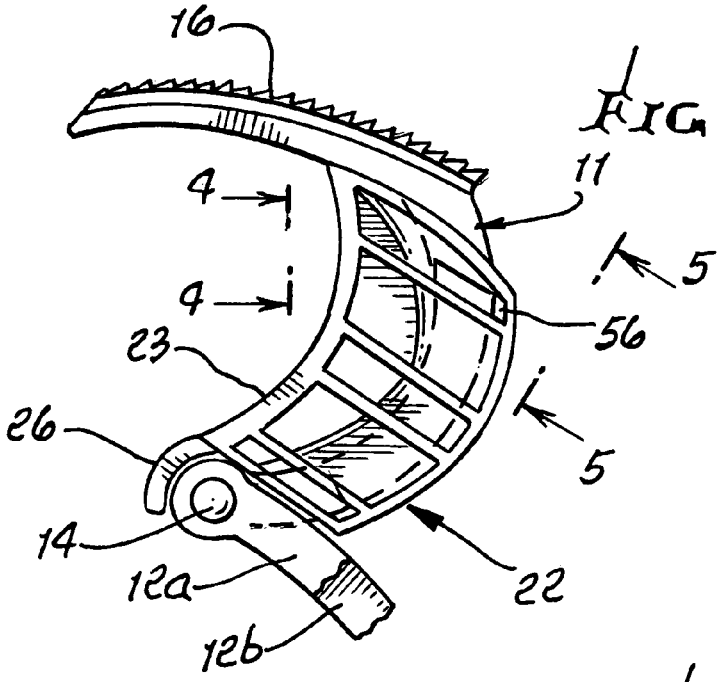
FIG. 3.
FIG. 4.
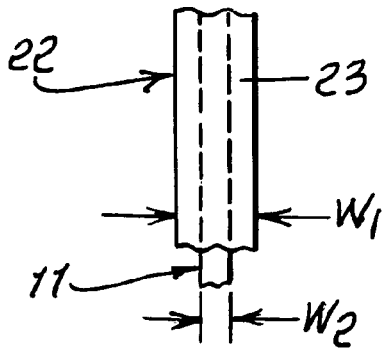
FIG. 5.
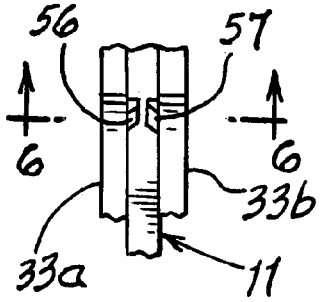
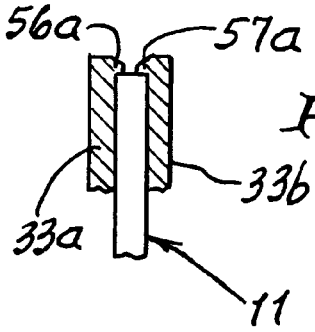
FIG. 6.

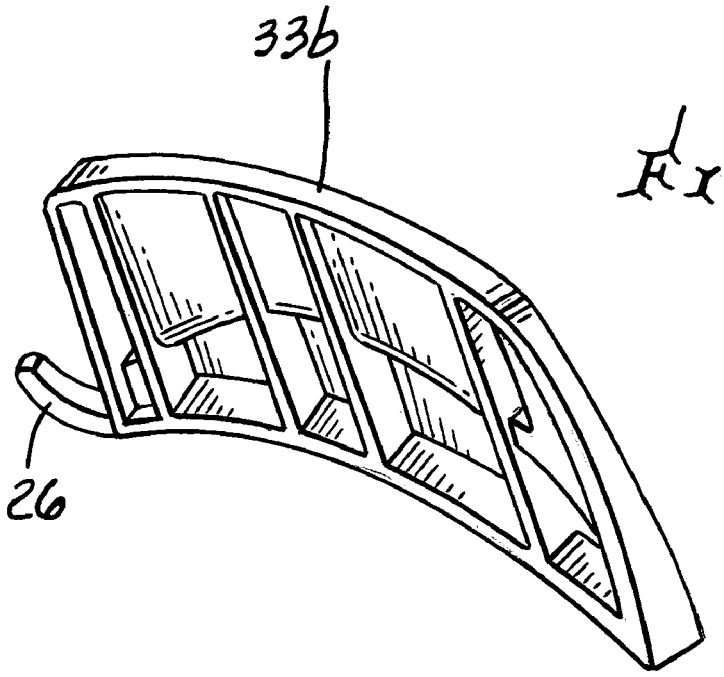
FIG. 7.
FIG. 8.
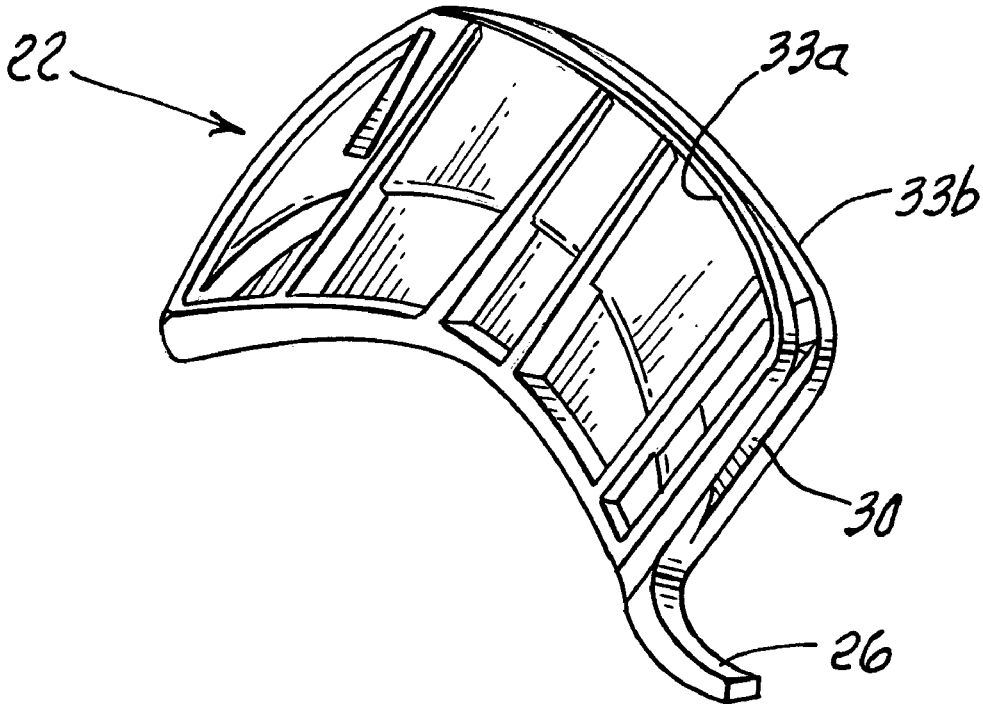

WRIST FITTING APPARATUS FOR HANDCUFFS

BACKGROUND OF THE INVENTION

This invention relates generally to improvements in handcuffs, and more particularly to wrist size adaptive handcuffs.

There is need for handcuffs that will fit a wide range of wrist sizes. There is particular need to fit smaller wrist sizes, below the range affordable by normal handcuff adjustment. There is also need for the improvement provided by the invention described and claimed herein, including its simplicity, safety, ease of installation on standard handcuffs, without disturbing the security function, ease of functioning and improved results.

SUMMARY OF THE INVENTION

It is a major object of the invention to provide a wrist fitting insert for handcuffs that meets the above described needs. Handcuffs normally have two curved jaws and a pivot connection for the jaws. The improved wrist fitting apparatus of the invention comprises:

a) an insert configured to interfit one jaw and present a wrist engaging curved surface toward the other jaw, b) the insert having a projection configured to fit over a terminal of said jaw.

It is another object of the invention to provide the projection in curved configuration to extend about at least part of the pivot connection structure. The insert itself typically defines a slot to receive a curved part of one jaw, whereby the insert is securely mounted on or carried by that one jaw. In this regard, the insert may have curved or arcuate channel shape, for readily interfitting and secure mounting on the one jaw as it adjusts relative to the other jaw, the projection assisting in retaining the insert to the one jaw. Also, the insert is readily removable from the one jaw.

Yet another object is to provide the curved insert to consist of molded plastic material, for smoothly adapting to a metallic handcuff jaw, in a handcuffing operation.

An additional object is to provide a handcuff accessory that reduces the minimum inside perimeter or area of confinement, of a handcuff. It is typically a one-piece injection molded plastic part that is placed on the inside radius of the handcuff locking jaw or arm. The primary purpose is to further constrict the opening of the handcuffs so that a person with a small wrist cannot simply slide his/her hand out of a fully closed handcuff. This situation can be found when handcuffing petite females, juveniles and elderly persons.

Another benefit or application of the invention is cushioning provided by the expanded surface area of the insert. The typical locking jaw or arm of a handcuff consists of a narrow piece of curved metal with defined edges. Prolonged contact with the wrist can produce abrasions and restrict blood flow to the hand. To avoid complaints of discomfort and wrist injuries, handcuffs are sometimes placed on with the locking jaw or arm loosely fitted to the wrist. Thus, the handcuff can slip and the prisoner has full use of both hands. With the use of this invention, in place, the locking arm can be fitted closer to the skin without inflicting tissue damage. A closer fit allows for a more secure restraint and for handcuffing for a longer period of time. When installed, the insert does not restrict placement of the handcuffs in a typical belt mounted handcuff carrying case. Additionally, the additional weight of the insert does not cause the handcuff to exceed the Federal handcuff weight limitation standard of 15 oz.

These and other objects and advantages of the invention, as well as the details of an illustrative embodiment, will be more fully understood from the following specification and drawings, in which:

DRAWING DESCRIPTION

FIG. 3 is like FIG. 2, but shows the insert completely swung into jaw interfit position;

FIG. 4 is a view taken on lines 4—4 of FIG. 3;

FIG. 5 is a view taken of lines 5—5 of FIG. 3 to show stop shoulders on the insert, to engage the handcuffs jaw;

FIG. 6 is a view taken on lines 6—6 of FIG. 5;

FIG. 7 is an enlarged perspective view showing the left end and one side of the insert as used in FIGS. 1 and 2;

FIG. 8 is an enlarged perspective view showing the right end and opposite side of the insert seen in FIG. 7;

DETAILED DESCRIPTION

Figure 1:
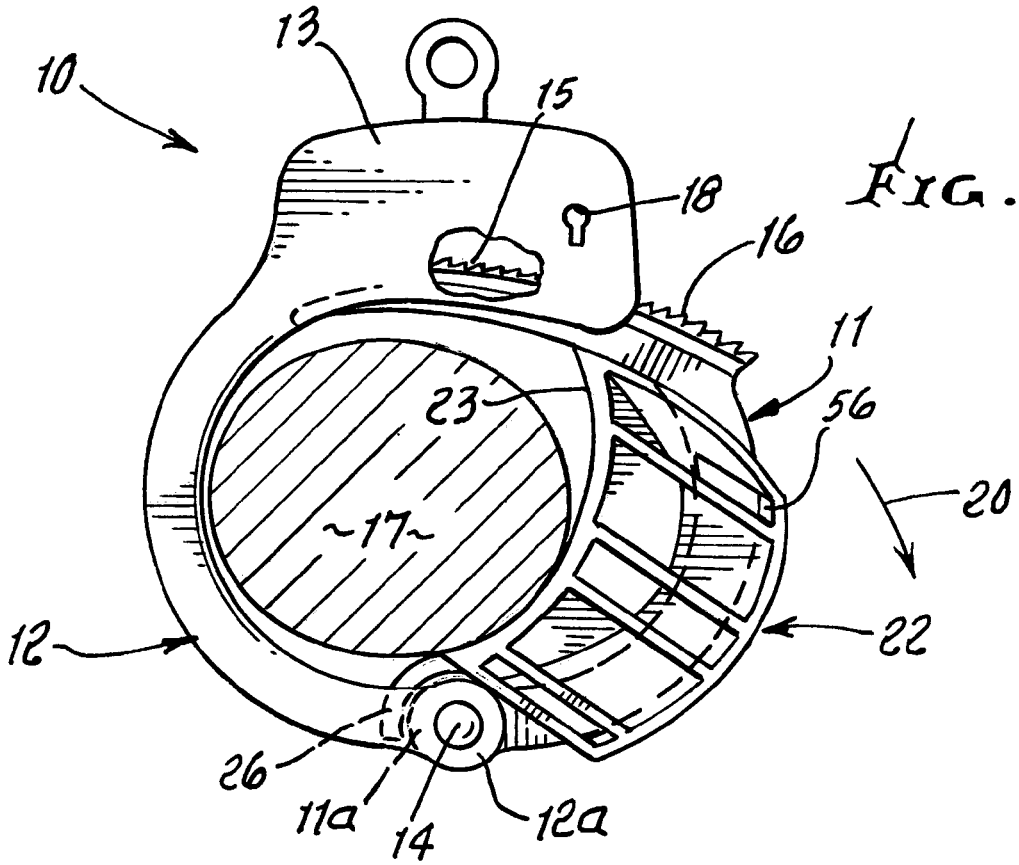
FIG. 1 is a view of a handcuff, carrying the wrist fitting apparatus of the invention.

In the drawings, a handcuff 10 includes two curved arms or jaws 11 and 12. Jaw 12 is integral with a support 13, and jaw 11 is pivotally connected at 14 to the end portion 12*a* of jaw 12. Serrations 15 within 13 are engageable by serrations 16 on jaw 11, as the handcuff is closed on a human wrist shown at 17. A key, not shown, is used in keyway 18 to release the handcuffs, i.e. release jaw 11 to pivot in the direction of arrow 20, freeing the wrist.

In accordance with a preferred form of the invention, as shown, a wrist retention apparatus is provided for combination with the handcuff 10. As shown, it includes a size adapter, such as insert 22 configured to interfit one jaw (for example jaw 11) in such a way that it presents a wrist engaging surface 23 toward the other jaw 12. That surface typically has width $w_1$ (see FIG. 4) that substantially exceeds the width $w_2$ of the jaw 11 with which the insert meshes.

The insert or adapter 22 has a projection or tang 26 configured to interfit the rounded end 11*a* of jaw 11, through which the pivot 14 extends from spaced, parallel sections 12*a* and 12*b* of jaw 12. See FIGS. 1 and 3. Pivot 14 accordingly extends through 12*a*, 11*a* and 12*b*, and tang fits over 11*a*.

Figure 2:
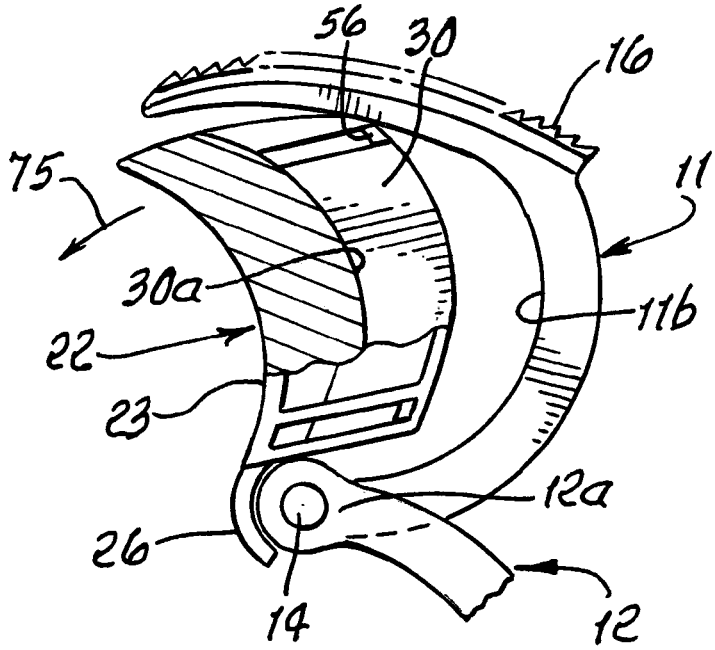
FIG. 2 is a view showing the wrist fitting apparatus or insert at a stage of attachment to a handcuffs jaw.
Figure 9:
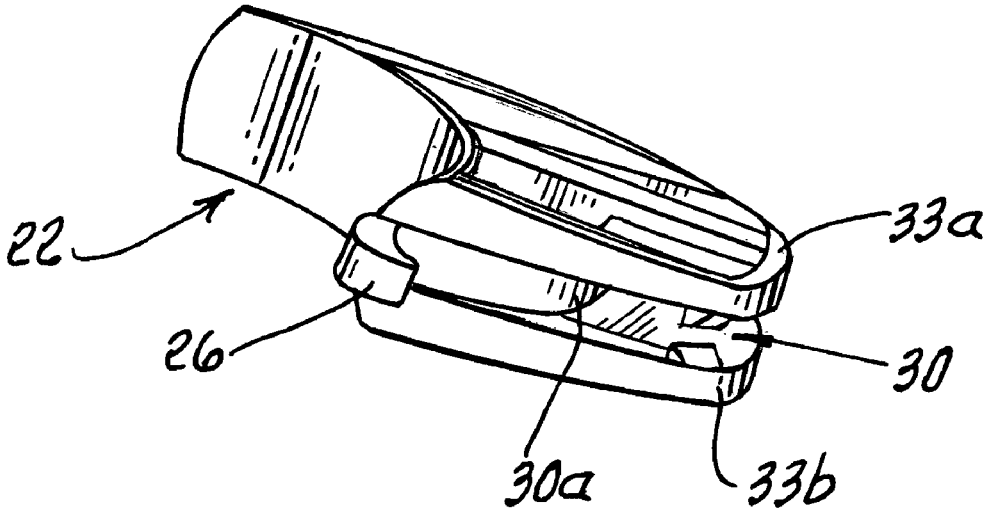
FIG. 9 is a perspective view taken toward the left end of the insert seen in FIG. 7, and showing the slot and channel shape of the wrist.
Figure 10:
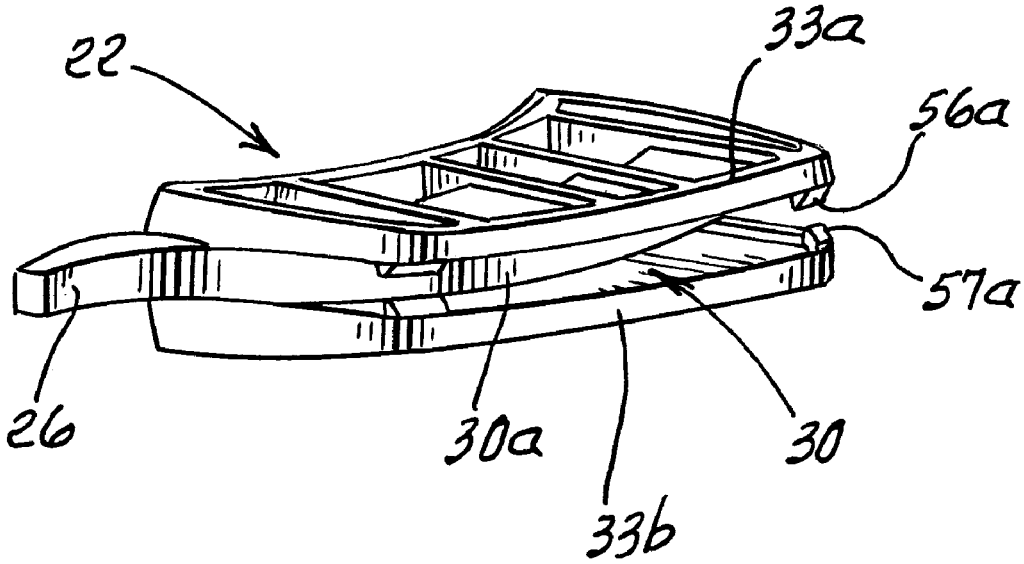
FIG. 10 is a perspective view taken toward the left end and bottom of the insert as seen in FIGS. 7 and 9.

As shown in FIGS. 1–3, and 10 the adapter or insert 22 is channel shaped, with curvature along its length, as indicated by the curved slot 30 having an interior surface 30*a* which is presented with convexity toward the concave edge 11*b* of jaw 11, as seen in FIG. 2. That view shows the insert or adapter being swung, upon assembly, about pivot 14, toward the jaw 11, so that two side plates 33*a* and 33*b* of the insert straddle the jaw 11 in assembled position, seen in FIG. 3. Such straddling, and the pivoting locating of curved tang 26, serve to position the insert or adapter in FIG. 1 and FIG. 3 position, whereby surface 23 cooperates with jaw 12 to closes about a relatively small wrist. The width $w_1$ is such that it cooperates with the overall width of the two jaw 12 sections 12*a* and 12*b* to enhance comfort to the captivated wrist. Selective engagement of the serrations 15 and 16 adjusts the position of the insert and jaw 11, to fit a range of smaller wrist sizes. The insert typically consists of molded plastic material.

Also provided is a stop shoulder on the insert to be received adjacent an outer edge of said one jaw for retaining the insert in assembled position adjacent said one jaw; FIGS. 3, 5 and 6 show two of such shoulders 56 and 57 on protuberances 56*a* and 57*a* respectively integral with the side plates or walls 33*a* and 33*b*. Those walls spread apart as said stop shoulders slide over said one jaw towards said assembled position, and away from said assembled position upon removal of the insert off the handcuff. Accordingly, the walls and the insert are held in position as seen in FIGS. 1 and 3, attached to jaw 11 during use of the handcuff; however, the insert may easily be removed from the jaw by pulling it in direction 75 (see FIG. 2) to cause the protruberances to spread, and then slide off the jaw, when the jaws 11 and 12 are in positions as seen in FIG. 2.

We claim:

1. Wrist retention apparatus for hand cuffs that have two curved jaws, and a pivot connection for the jaws, comprising in combination:

a) an insert configured to interfit one jaw and present a wrist engaging curved surface toward the other jaw, b) the insert having a tang configured to fit over a terminal of said jaw, c) said tang being curved and open sided to fit sidewardly on said jaw terminal, between two sections of the other jaw, the tang projecting away from the insert, at a free end thereof, d) the insert being channel shaped and having two parallel walls at opposite sides of a slot, to straddle the one jaw, e) and including oppositely projecting and spaced apart protuberances on said walls and defining spaced stop shoulders to be received adjacent outer edges of said one jaw, for retaining the insert in assembled position on said one jaw.

2. The combination of claim 1 wherein said insert defines said slot to receive a curved part of said one jaw.

3. The combination of claim 1 including a set of said inserts sized to fit different sized wrists.

4. The combination of claim 2 wherein said insert has curved channel shape.

5. The combination of claim 1 in which the insert consists of molded plastic material.

6. The combination of claim 1 wherein said walls are configured to spread apart as said stop shoulders slide over said one jaw towards said assembled position, and away from said assembled position upon removal of the insert off the handcuff.

7. The combination of claim 1 wherein said wrist engaging curved surface has width which substantially exceeds the width of one jaw at the interfit location.

* * * * *